US005967214A

United States Patent [19]

Beretta

[11] Patent Number: 5,967,214

[45] Date of Patent: Oct. 19, 1999

[54] BARRIER FOR DELIMITING SPACES, INDICATING PATHS, POINTING OUT DANGERS AND THE LIKE

[75] Inventor: Mario Beretta, Sirtori, Italy

[73] Assignee: Tenax S.p.A., Vigano', Italy

[21] Appl. No.: 09/027,957

[22] Filed: Feb. 23, 1998

[30] Foreign Application Priority Data

Feb. 26, 1997 [IT] Italy ..... MI97A0421

[51] Int. Cl.[6] ..... A47G 5/00

[52] U.S. Cl. ..... 160/135; 160/371; 16/366; 256/26

[58] Field of Search ..... 160/135, 351, 160/229.1, 371; 16/366; 256/25, 26

[56] References Cited

U.S. PATENT DOCUMENTS

| | | | |
|---|---|---|---|
| 2,939,153 | 6/1960 | Arnold et al. | 256/25 |
| 4,134,439 | 1/1979 | Scott | 160/135 |
| 4,299,507 | 11/1981 | Collis, II | 256/26 |
| 4,516,620 | 5/1985 | Malhern | 160/351 |
| 5,070,665 | 12/1991 | Marrin et al. | 160/135 |
| 5,352,149 | 10/1994 | Melasheko | 160/135 |
| 5,402,988 | 4/1995 | Eisele | 160/351 |
| 5,593,706 | 1/1997 | Specht . | |

FOREIGN PATENT DOCUMENTS

| | | | |
|---|---|---|---|
| 1078295 | 11/1954 | France | 160/135 |
| 503350 | 4/1939 | Germany | 160/135 |
| 492027 | 9/1938 | United Kingdom | 160/135 |
| 498323 | 1/1939 | United Kingdom | 160/135 |

*Primary Examiner*—Blair M. Johnson
*Attorney, Agent, or Firm*—Guido Modiano; Albert Josif

[57] ABSTRACT

A barrier for delimiting spaces, indicating paths, pointing out dangers and the like, comprising a tubular frame which has a closed shape and to which a sheet-like element made of extruded plastics and closed in a loop can be applied, the sheet-like element being anchored to two mutually opposite portions of the frame by shrinkage produced by a thermal treatment.

21 Claims, 5 Drawing Sheets

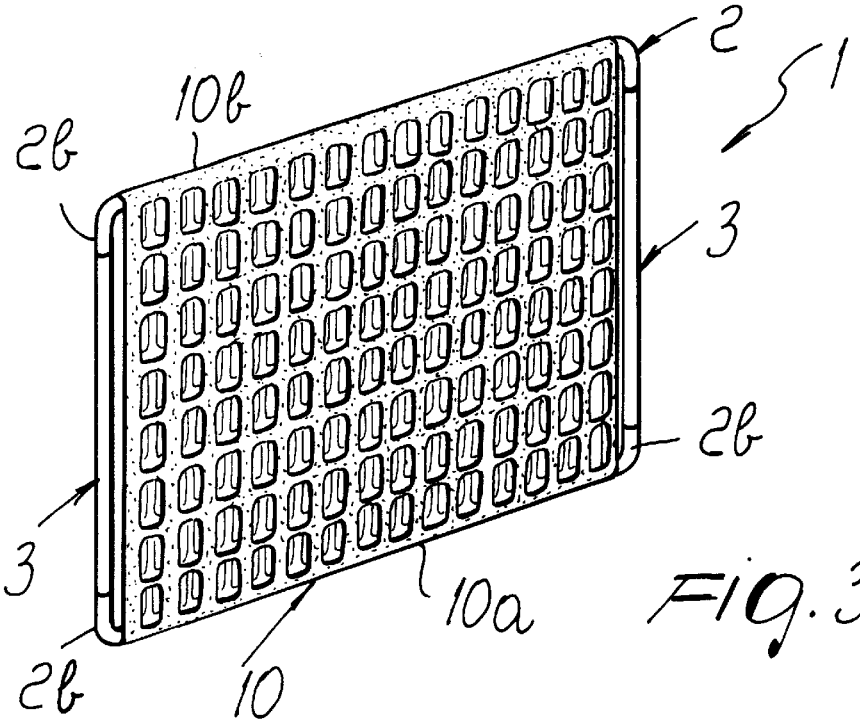
FIG. 3
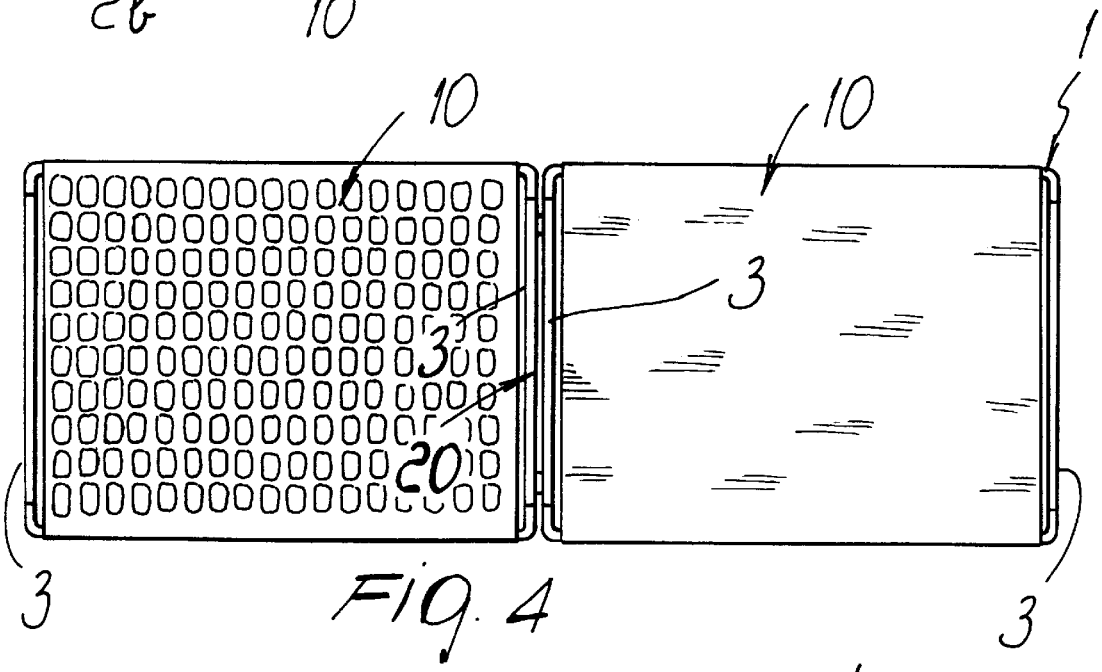
FIG. 4
FIG. 5
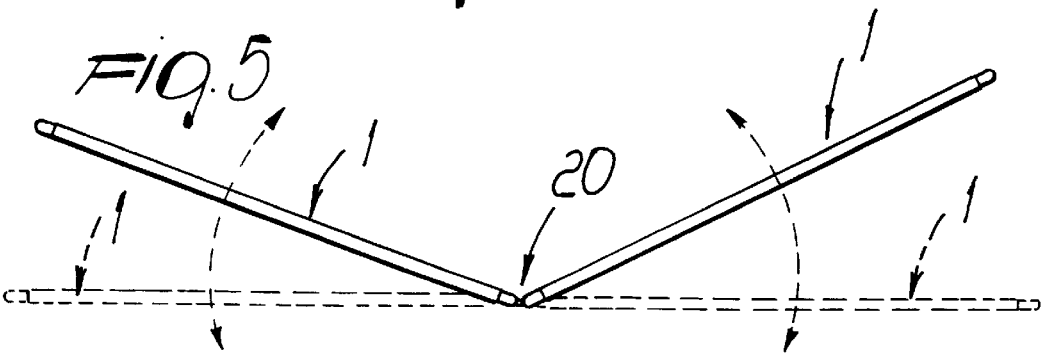

BARRIER FOR DELIMITING SPACES, INDICATING PATHS, POINTING OUT DANGERS AND THE LIKE

BACKGROUND OF THE INVENTION

The present invention relates to a barrier for delimiting spaces, indicating paths, pointing out dangers and the like.

It is known that barriers for forming partitioning or delimiting elements are already commercially available and are generally formed by means of a tubular metal frame which has a closed shape and acts as a surrounding element, for example, for a plurality of bars which are welded to the frame or for a panel which is screwed to said frame.

Other solutions provide wood trestles or in any case elements which are always difficult to handle and have a considerable weight and bulk, causing serious problems in the transport and storage thereof.

Other enclosure solutions use plastic elements, such as nets and the like, but these solutions are generally flimsy and require supporting elements which must be fixed to the ground and therefore require an installation which is difficult to move.

SUMMARY OF THE INVENTION

The aim of the present invention is to solve the above problems, by providing a barrier for delimiting spaces, indicating paths, pointing out dangers and the like which can be obtained by means of modular elements which are very light but have a considerable mechanical strength and can be arranged mutually adjacent so as to obtain any configuration deemed appropriate.

Within the scope of this aim, a particular object of the present invention is to provide a barrier in which it is possible to obtain partitioning elements which are particularly easy to handle and can be easily arranged mutually adjacent during storage without having empty spaces.

Another object of the present invention is to provide a barrier which starting from a basic element allows to obtain a wide range of installations by utilizing suitable completion accessories.

Another object of the present invention is to provide a barrier for delimiting spaces, indicating paths, pointing out dangers and the like which can be easily obtained starting from commonly commercially available elements and materials and is also competitive from a merely economical point of view.

This aim, these objects and others which will become apparent hereinafter are achieved by a barrier for delimiting spaces, indicating paths, pointing out dangers and the like, according to the present invention, characterized in that it comprises a tubular frame which has a closed shape and to which a sheet-like element made of extruded plastics and closed in a loop can be applied, said sheet-like element being anchored to two mutually opposite portions of said frame by shrinkage produced by a thermal treatment.

BRIEF DESCRIPTION OF THE DRAWINGS

Further characteristics and advantages of the present invention will become apparent from the following detailed description of a preferred but not exclusive embodiment of a barrier for delimiting spaces, indicating paths, pointing out dangers and the like, illustrated only by way of non-limitative example in the accompanying drawings, wherein:

FIG. 3 is a view of the sheet-like element, rigidly coupled to the tubular frame;

FIG. 4 is a schematic front view of two mutually hinged barrier elements, one of which is shown with a net, the other element being shown with a continuous layer;

FIG. 5 is a plan view of two barrier elements, illustrating the possibility to mutually rotate;

DESCRIPTION OF THE PREFERRED EMBODIMENTS

Figure 1:
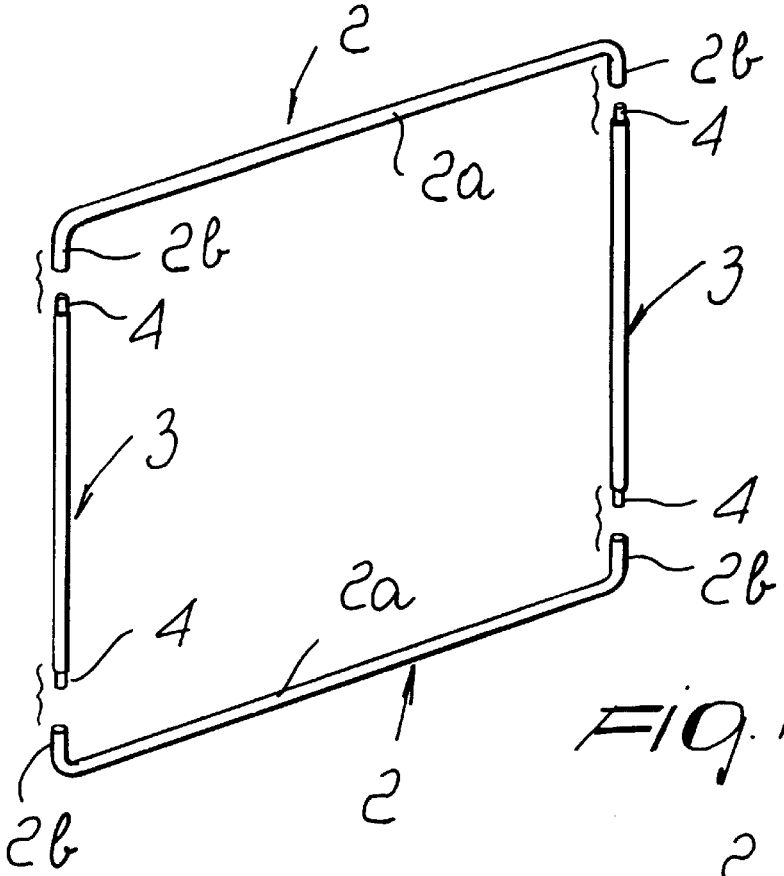
FIG. 1 is a schematic exploded perspective view of the elements that constitute the tubular frame having a closed shape.
Figure 2:
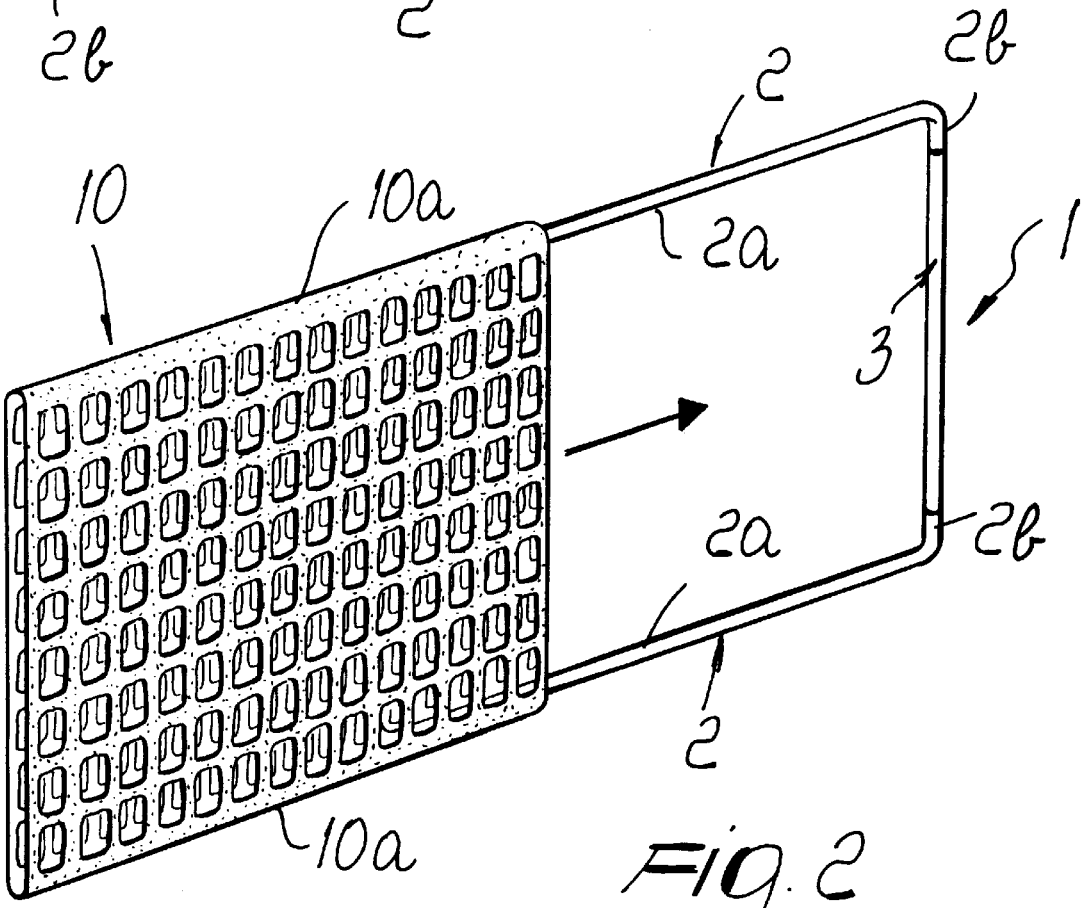
FIG. 2 is a perspective view of the step for applying the sheet-like element closed in a loop over the tubular frame.

With reference to the above figures and in particular to FIG. 1, the barrier for delimiting spaces, indicating paths, pointing out dangers and the like, according to the present invention, comprises a tubular frame, generally designated by the reference numeral 1, which has a closed shape and is advantageously constituted by two transverse elements 2 having a straight portion 2*a* and a curved end portion 2*b*; said transverse elements are coupled to posts 3 which have, at their end, insertion-coupling elements 4 which enter the end of the curved portions 2*b* of the transverse elements 2.

The tubular frame is thus constituted by tubular portions which can be mutually joined and advantageously has a square or rectangular configuration.

A sheet-like element 10 made of plastics can be applied to the tubular frame 1 having a closed shape; the sheet-like element can be advantageously constituted by an extruded plastic net or optionally by extruded continuous plastic layers.

The sheet-like element can be extruded directly with an annular shape, thus using a portion thereof which is fitted over the frame 1.

In this embodiment, the sheet-like element 10 or tubular net is stretched transversely, obtaining in practice a loop of net which is fitted over the tubular frame 1.

It is optionally possible to use a longitudinally stretched net which is joined at its ends so as to form the loop and be fitted over the tubular frame 1.

Once the sheet-like element 10, closed in a loop because it is formed directly with an annular shape or because it is joined at the end of a segment, has been applied to the frame 1, it is subjected to shrinkage by thermal treatment.

Such shrinkage allows to consolidate the tubular structure 1 constituted by the interlocked elements, as mentioned above.

It has been found experimentally that it is convenient to use a net or sheet-like element 10 which can shrink by a percentage which is at least equal to the stretch ratio applied; thermal treatment is advantageously performed at a temperature above 50°.

It is also possible to extrude a tubular net containing elasticizing additives, so that the resulting loop of net, when heated to a temperature above 50°, undergoes a shrinkage which is equal to at least 2% of the length of the net 10.

Shrinkage by thermal treatment of the net 10 in practice forms a monolithic assembly.

The net 10 is arranged so as to advantageously have continuous portions 10*a*, i.e., portions not affected by the holes, which lie at the regions for gripping the frame 1.

The extension of the sheet-like element 10 at right angles to the direction in which it is closed in a loop preferably leaves on the outside the tubular portions that are arranged substantially at right angles to the grip portions.

Advantageously, said portions can be constituted by said vertical posts or by vertical posts which are coupled in order to produce the mutual coupling of two tubular frames arranged side by side, with the possibility to rotate with respect to each other.

Figure 8:
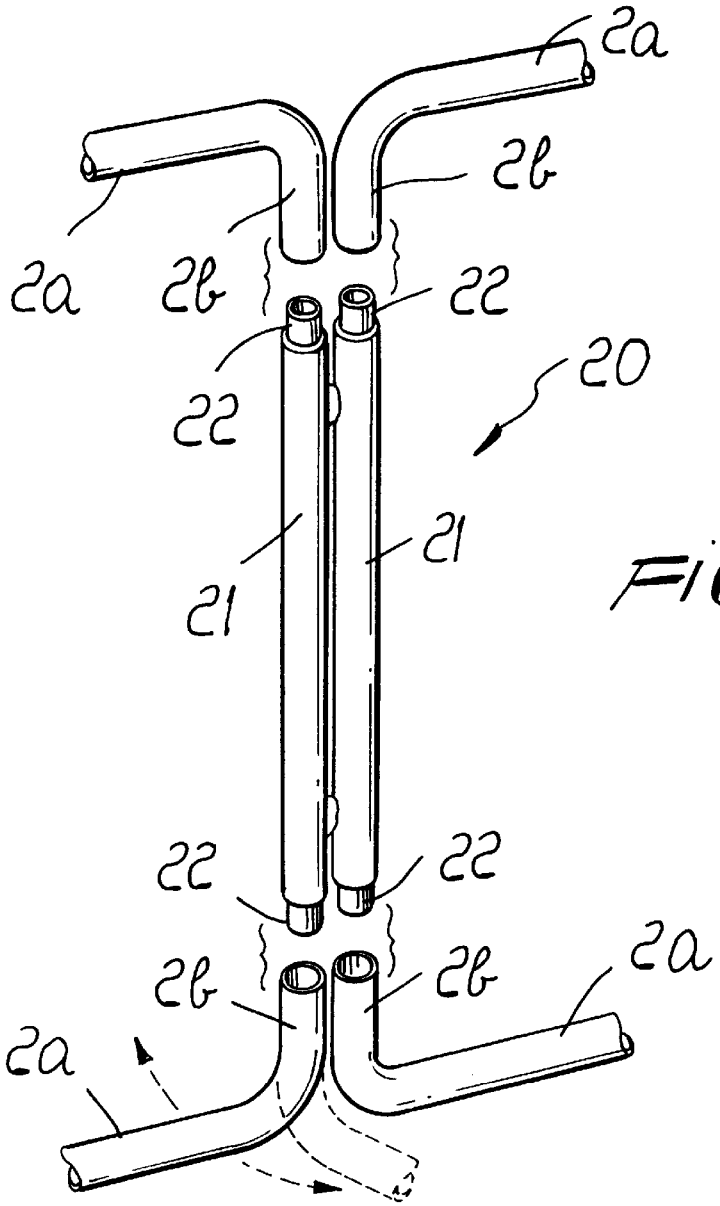
FIG. 8 is a schematic perspective view of the element for the hinged coupling of two tubular frames arranged side by side.
Figure 9:
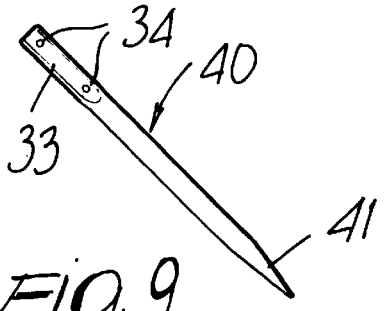
FIG. 9 is a perspective view of a stake for fixing the barriers to the ground.
Figure 10:
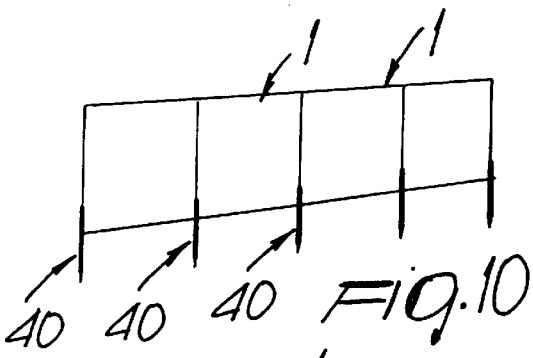
FIG. 10 is a schematic view of a plurality of barriers arranged side by side and fixed to the ground by means of stakes.

As clearly shown in FIGS. 5 and 8, it is possible to provide a connecting element 20 constituted by two mutually welded or otherwise coupled posts 21 which end with cylindrical insertion-coupling elements 22 fully identical to the insertion-coupling elements 4 which allow to provide a hinged coupling to the curved end portions of the transverse elements of the tubular frames 1 arranged side by side.

Figure 6:
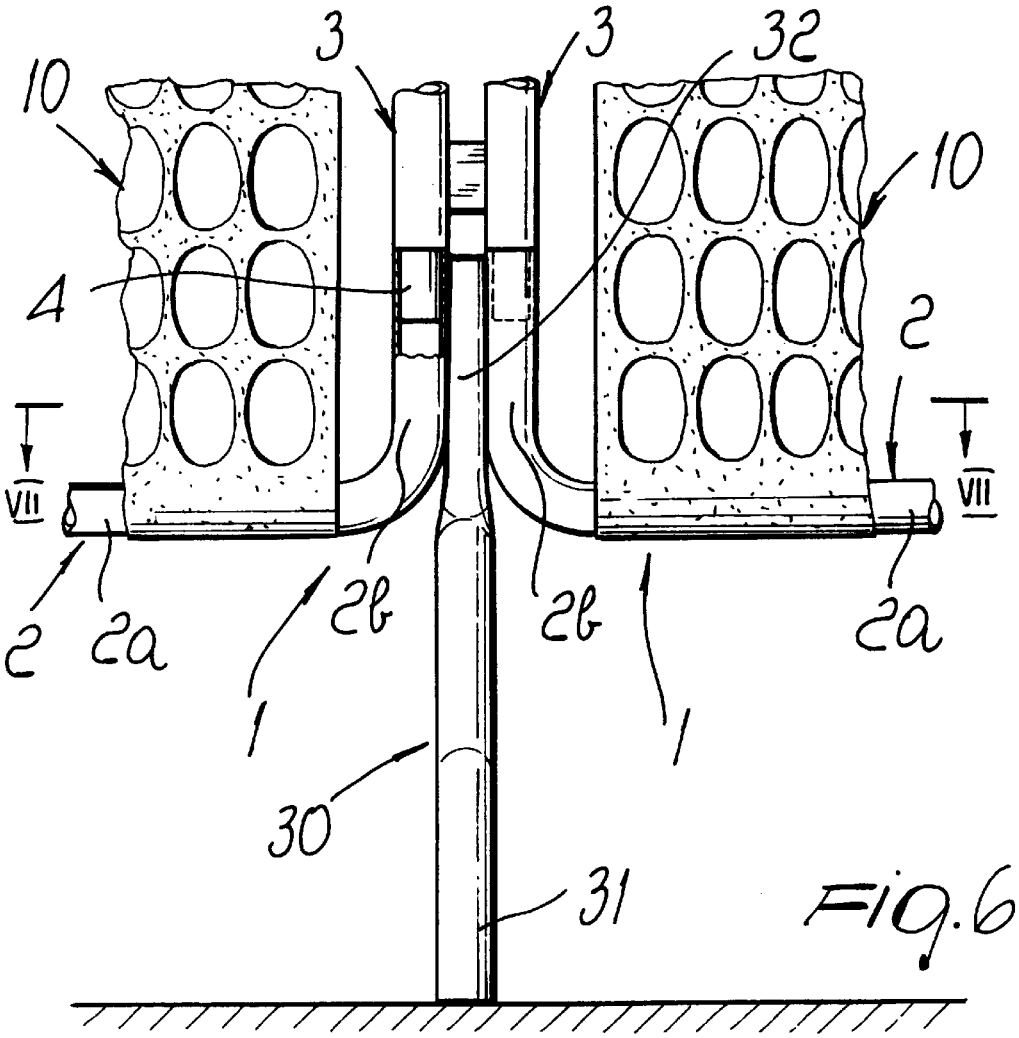
FIG. 6 is a schematic view of the detail of the coupling of a supporting foot between two tubular frames arranged side by side.

As shown in FIG. 6, the connecting portions produce a mutual spacing in which it is possible to insert accessory elements for supporting the frames 1, obtaining both an interlock coupling and the possibility of a mutual rotation of the frames.

Figure 7:
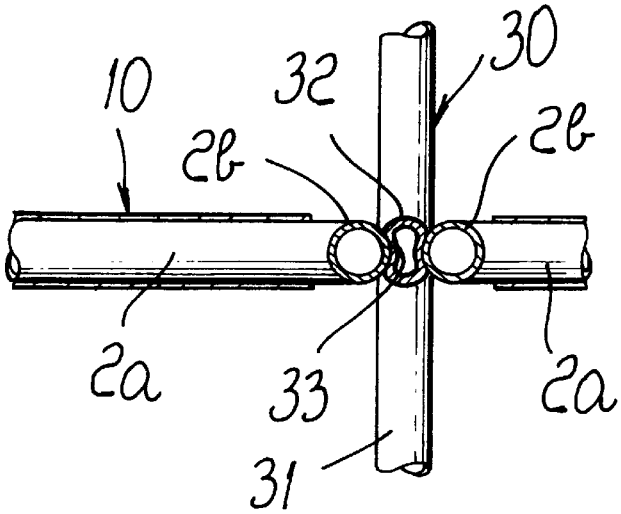
FIG. 7 is a sectional view, taken along the plane VII—VII of FIG. 6.

Said accessory elements can be constituted by supporting feet 30, as shown in FIGS. 6 and 7, which form base portions 31 from which there extends a post 32 which has a flattened region 33 that allows the interlocking of two frames 1 arranged side by side, thus obtaining an insertion coupling, also by utilizing the taper that affects the vertical portion owing to a gradual flattening.

It is optionally possible to also provide through holes 34 for connecting fixing pins or in any case to connect the supporting feet 30 at their ends.

Again by using the same insertion-coupling principle, it is possible to provide stakes 40 which have, at one end, the flattened region 33 and have, at the other end, a point 41 for penetration.

Figure 11:
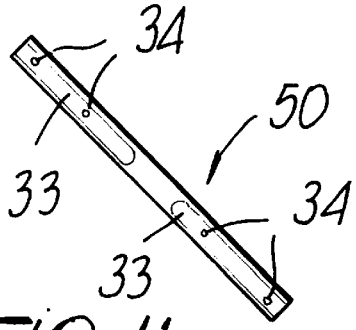
FIG. 11 is a schematic view of an element for stacking barriers.
Figure 12:
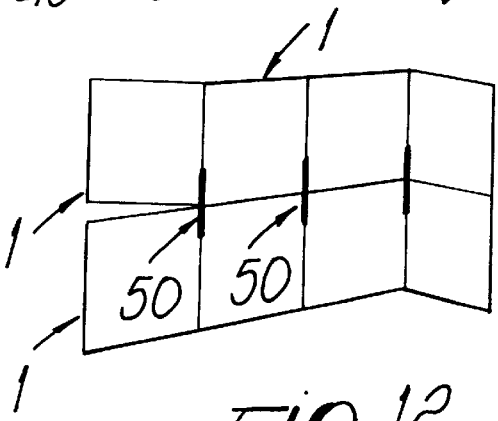
FIG. 12 is a schematic view of barriers arranged in a stacked configuration.
Figure 13:
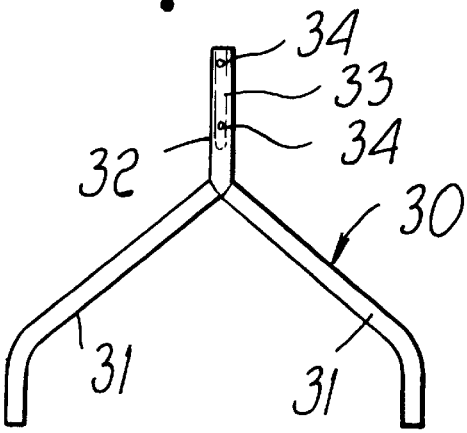
FIG. 13 is a view of the supporting foot.
Figure 14:
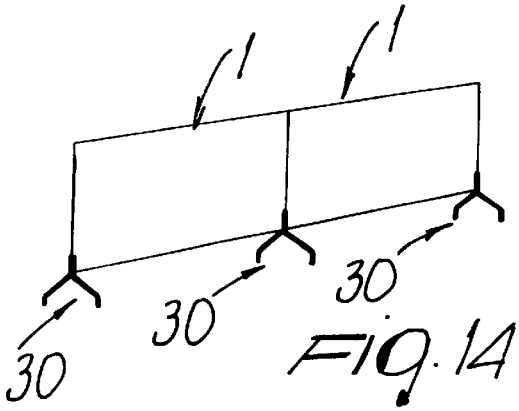
FIG. 14 is a view of two barriers arranged side by side with the corresponding supporting feet.

It is also possible, as shown in FIG. 11, to provide stacking elements constituted by segments 50 which have, at both ends, the flattened regions 33 that fit inside mutually stacked barriers, utilizing the same interlock principle described above.

Figure 15:
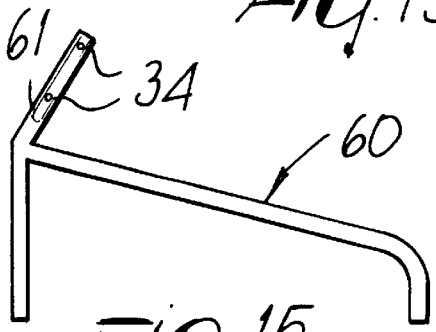
FIG. 15 is a view of a supporting foot for an inclined barrier.
Figure 16:
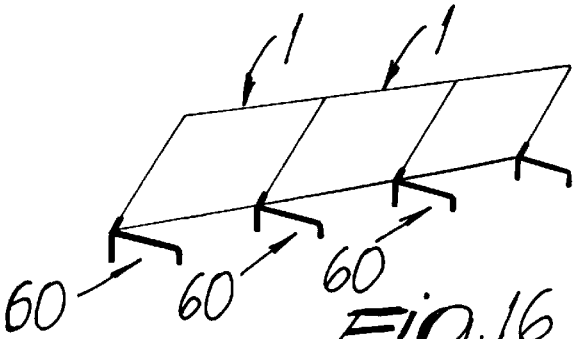
FIG. 16 is a schematic view of barriers arranged at an angle.

As shown in FIG. 15, it is possible to provide an inclined supporting foot 60 having an inclined portion 61 which again has the flattened regions 33 to provide a coupling which is fully identical to the one described above.

Figure 17:
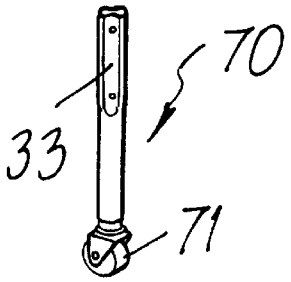
FIG. 17 is a perspective view of a wheeled supporting foot.
Figure 18:
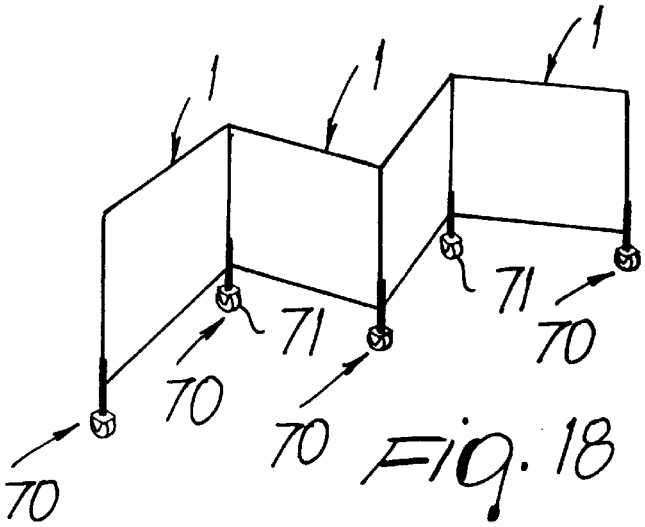
FIG. 18 is a perspective view of barriers with a wheeled support.

FIG. 17 illustrates a supporting element 70 which ends, in a downward region, with a wheel 71 and is provided, in an upward portion, with the flattened regions 33.

From the above description it is thus evident that the present invention achieves the intended aim and objects, and in particular the fact is stressed that a particularly light and handy barrier is provided which allows to provide tubular frames which are mutually pivoted so that they can mutually rotate through 360° and allows to add accessory elements for ground support, for anchoring to the ground, for stacking or in any case for mutually connecting two frames having the same structure.

Moreover, use of a sheet-like element or of a net made of extruded plastics allows to obtain a component which is highly monolithic and solid yet is remarkably lightweight.

It should be added to the above that the net according to the present invention forms a convenient supporting element for signs and the like.

The invention thus conceived is susceptible of numerous modifications and variations, all of which are within the scope of the inventive concept.

All the details may also be replaced with other technically equivalent elements.

In practice, the materials employed, as well as the contingent shapes and dimensions, may be any according to requirements.

What is claimed is:

1. A barrier for delimiting spaces, indicating paths, pointing out dangers and the like, comprising a tubular frame of interlocked tubular portions which has a closed shape and about which a sheet-like element made of extruded plastics and closed in a loop is applied, said sheet-like element being anchored to two mutually opposite portions of said frame by shrinkage produced by a thermal treatment of said sheet-like element to consolidate said interlocked tubular portions of said frame and to form a monolithic assembly, said tubular frame being constituted by elements which can be mutually coupled, the barrier further composing an element for mutually connecting two frames so as to allow pivoting, said element comprising two posts which are mutually joined and arranged side by side and have, at their ends, cylindrical insertion-coupling elements which can be rotatably coupled to the curved portions of transverse elements that form said frame, and between the posts of two frames arranged side by side accessories being inserted which have a coupling portion constituted by a tubular element provided with a flattened region that can be inserted between the posts of the two frames arranged side by side.

2. A barrier according to claim 1, wherein said tubular frame has transverse elements with a straight portion which blends with a curved end portion, posts being coupled to said curved end portion, said posts having, at their ends, insertion-coupling elements which can be inserted in said curved end portions.

3. A barrier according to claim 1, wherein said sheet-like element has a continuous surface.

4. A barrier according to claim 1, wherein said sheet-like element has a substantially net-like configuration.

5. A barrier according to claim 1, wherein said sheet-like element is extruded in the shape of a loop and is subjected to transverse stretching.

6. A barrier according to claim 1, wherein said sheet-like element is constituted by a longitudinally stretched portion which is joined at its ends so as to form a loop.

7. A barrier according to claim 1, wherein said sheet-like element has a shrinkage due to thermal treatment which is at least equal to the applied stretching ratio.

8. A barrier according to claim 1, wherein said sheet-like element is obtained from an extruded component with elasticizing additives for generating shrinkage during thermal treatment.

9. A barrier according to claim 1, wherein said shrinkage is equal to at least 2%.

10. A barrier according to claim 1, wherein said sheet-like element is subjected to a thermal treatment at a temperature above 50° C.

11. A barrier according to claim 4, wherein said sheet-like element in the shape of a net has continuous portions which are not affected by holes of the net and are arranged at a region for coupling to transverse elements of said frame.

12. A barrier according to claim 2, wherein said sheet-like element leaves said posts free.

13. A barrier according to claim 1, wherein said accessories comprise supporting feet which form base portions from which there extends a post which has a flattened region for the interlocking of mutually opposite frames and has, at a coupling region, a substantially conical expanded portion.

14. A barrier according to claim 1, further comprising stakes which form said flattened region at one end and a penetration point at the other end.

15. A barrier according to claim 1, wherein said accessories comprise stacking elements constituted by segments which form said flattened regions at both ends.

16. A barrier according to claim 1, wherein said accessories have a supporting foot with an inclined portion provided with said flattened region.

17. A barrier according to claim 1, wherein said accessories comprise a supporting element provided with a wheel in a downward region.

18. A barrier according to claim 1, comprising through holes at said flattened region for the insertion of fixing pins at the outer posts of frames arranged side by side.

19. A barrier according to claim 1, wherein said sheet-like element closed in a loop has two mutually oppositely arranged open ends and said tubular frame has two free portions each arranged adjacent a respective one of said two open ends of said sheet-like element outside of said sheet-like element so as to be not covered by said sheet-like element such that each of said two free portions of said tubular frame may be coupled to a similar free portion of a further adjacently arranged tubular frame.

20. A space-delimiting barrier comprising:

a frame element with a closed shape; and a sheet-like element made of extruded plastics and closed in a loop and having two mutually oppositely arranged open ends, said sheet-like element surrounding said frame element so as to be anchored to two mutually opposite portions of said frame element by shrinkage produced by a thermal treatment of said sheet-like element and such that two free portions of said frame element are defined each of which is arranged adjacent a respective one of said two open ends of said sheet-like element outside of said sheet-like element so as to be not covered by said sheet-like element such that each of said two free portions of said frame element may be coupled to a similar free portion of a further adjacently arranged frame element;

said tubular frame being constituted by elements which can be mutually coupled, the barrier further comprising an element for mutually connecting two frames so as to allow pivoting, said element comprising two post which are mutually joined and arranged side by side and have, at their ends, cylindrical insertion-coupling elements which can be rotatably coupled to the curved portions of the transverse elements that form said frame, and between the posts of two frames arranged side by side accessories being inserted which have a coupling portion constituted by a tubular element provided with a flattened region that can be inserted between the posts of the two frames arranged side by side.

21. A space-delimiting barrier comprising:

a frame element with a closed shape;

a sheet-like element made of extruded plastics and closed in a loop and having two mutually oppositely arranged open ends, said sheet-like element surrounding said frame element so as to be anchored to two mutually opposite portions of said frame element by shrinkage produced by a thermal treatment of said sheet-like element and such that two free portions of said frame element are defined each of which is arranged adjacent a respective one of said two open ends of said sheet-like element outside of said sheet-like element so as to be not covered by said sheet-like element; and coupling elements attached to said free portions of said frame element such that each of said free portions of said frame element may be coupled to a similar free portion of a further adjacently arranged frame element;

said tubular frame being constituted by elements which can be mutually coupled, the barrier further comprising an element for mutually connecting two frames so as to allow pivoting, said element comprising two posts which are mutually joined and arranged side by side and have, at their ends, cylindrical insertion-coupling elements which can be rotatably coupled to the curved portions of the transverse elements that form said frame, and between the posts of two frames arranged side by side accessories being inserted which have a coupling portion constituted tubular element provided with a flattened region that can be inserted between the posts of the two frames arranged side by side.

* * * * *